United States Patent [19]

Trees

[11] 3,973,323

[45] Aug. 10, 1976

[54] SHAVING HEAD FOR A DRY-SHAVING APPARATUS

[75] Inventor: Ferdinand Marinus Trees, Drachten, Netherlands

[73] Assignee: U.S. Philips Corporation, New York, N.Y.

[22] Filed: June 19, 1974

[21] Appl. No.: 480,676

Related U.S. Application Data

[63] Continuation of Ser. No. 259,598, June 5, 1972, abandoned.

[30] Foreign Application Priority Data

June 12, 1971 Netherlands ..... 7108090

[52] U.S. Cl. ..... 30/43.92

[51] Int. Cl.[2] ..... B26B 19/02

[58] Field of Search..... 30/43.1, 43.8, 43.9, 30/43.91, 43.92, 346.51

[56] References Cited

UNITED STATES PATENTS

| | | | |
|---|---|---|---|
| 2,286,443 | 6/1942 | Scully | 30/43.92 |
| 2,526,153 | 10/1950 | Page | 30/43.91 |
| 3,399,454 | 9/1968 | Liska | 30/43.92 |

FOREIGN PATENTS OR APPLICATIONS

| | | | |
|---|---|---|---|
| 1,553,713 | 10/1970 | Germany | 30/346.51 |

*Primary Examiner*—Al Lawrence Smith
*Assistant Examiner*—Gary L. Smith
*Attorney, Agent, or Firm*—Frank R. Trifari; J. David Dainow

[57] ABSTRACT

A dry-shaver with a flexible foil shear plate and a reciprocating cutter, the cutter comprising a plurality of cutting elements each having a generally elliptic shape, the cutter being tiltable about an axis parallel to the direction of reciprocating movement, with a tendency of the cutter to tilt toward the point at which pressure is applied through the shear plate onto the cutter.

3 Claims, 8 Drawing Figures

SHAVING HEAD FOR A DRY-SHAVING APPARATUS

This is a continuation of application Ser. No. 259,598, filed June 5, 1972 (now abandoned).

BACKGROUND OF THE INVENTION

The invention relates to a shaving head for a dry-shaving apparatus which is adapted to be driven by an electric motor and is of the type in which a cutting structure provided with a plurality of cutting edges is arranged to be driven into reciprocating translation by means of a driving member coupled to a driving motor. The cutting edges cooperate with a thin resilient curved shear foil which is stretched across the cutting structure and is provided with hair entrance openings. Also there is provided between the cutting structure and the driving element a driving coupling such that the cutting structure, at least within certain limits, is tiltable about a tilting axis which extends parallel to the direction of the said translation.

Various embodiments of dry-shaving apparatus provided with a shaving head of the type described are known. For example a dry-shaving apparatus is known in which the cutting structure is hingedly coupled to the driving member. The pivotal axis extends in the direction of movement of the cutting structure. Furthermore dry-shaving apparatus are known which have a universal drive coupling, for example in that the end of a driving member coupled to a vibrator motor is spherical and is clampingly connected to resilient parts of the cutting structure. Such a universal drive coupling permits tilting of the cutting structure not only about a tilting axis which extends in the direction of movement, but also about two tilting axes at right angles thereto.

When during the use of the dry-shaving apparatus the shear foil of a shaving head of the type described is pressed against the parts of the skin to be shaved, the cutting structure may perform not only a reciprocating motion but also tilting movements. The tilting movements will be of a periodic nature having a frequency equal to that of the reciprocating motion of the cutting structure.

Owing to the loading of the shear foil, forces are exerted on the cutting structure via this foil. Some of these forces are due to deformations of the shear foil. Under the action of all these forces the cutting structure is tilted, because tilting moments with respect to the tilting axis are produced. In the known shaving heads the direction of tilting of the cutting structure is such that the tilting produces an increase in the tilting moments. Hence, with respect to tilting, the equilibrium of the cutting structure is unstable, so that during use, the cutting structure will always tend to continue tilting in the instantaneous direction of tilting. Obviously limits must be set to the tilting; in the known dry-shaving apparatus this is achieved in that at a given instant further tilting is prevented by fixed parts of the apparatus or by the driving member itself, or in that the thrust springs which keep the cutting structure pressed against the shear foil counteract further tilting in a manner such as to produce a state of equilibrium.

In these cases the shaving effect of the shaving apparatus will be adversely affected, for owing to the tilting of the cutting structure the cutting action of the cutters and hence the shaving effect will decrease, because the cutting edges move to the unloaded area of the shear foil and hence out of the area at which the skin of the user presses against the shear foil. This is why directions for use of known dry-shaving apparatus contain the instruction for the user to hold the apparatus pressed against his face at right angles to the area being shaved. Since such manipulation of the dry-shaving apparatus is found to be tiring owing to the raised position in which the user must hold his arm for a comparatively long time, many users do not obey this instruction, with a consequent decrease in shaving effect.

Furthermore, owing to the large tilting moment which may eventually be produced, the frictional forces which are produced in the driving coupling between the driving member and the cutting structure and which do not act in the driving direction and the ensuing friction moments may assume values such that the cutting structure periodically, particularly at the ends of its stroke, will be locally moved away from the shear foil. This behaviour of the cutting structure contributes to a painful action of the shaving apparatus, because a tensile force is exerted on the hairs which are pinched between the shear foil and the cutting edges.

SUMMARY OF THE NEW INVENTION

It is an object of the invention to provide a shaving head of the type described at the beginning of this specification in which the said disadvantages are obviated and which is characterized in that the cutting edges are shaped so that in each point of the shear foil at which this is stretched tautly across the cutting structure, the local normal passes along the said tilting axis on the side more remote from the cutting edges.

This shaping according to the invention, in a sense, imparts a self-adjusting action to the cutting structure, i.e. when the shear foil is stressed by the skin of the user the cutting structure will tilt so that the shaving effect is increased and the aforementioned frictional forces and frictional moments in the drive coupling are reduced to a minimum. When the cutting structure is coupled to the drive member by a universal coupling the additional advantage is obtained that the moments exerted on the cutting structure by the load about axes which pass through the drive coupling at right angles to the tilting axis which extends in the drive direction are also reduced by the tilting.

One embodiment of the invention is characterized in that the cutting edges are shaped so that, going from one cutting edge to the other, the radius of curvature of the cutting edge initially increases gradually and then decreases gradually.

It has been found that owing to such shaping of the cutting edges the shear foil is deformed in a slight degree only when the cutting structure tilts about the tilting axis which extends in the direction of movement. Since deformaton of the shear foil entails the production of restoring moments which are exerted on the cutting structure by the foil and oppose the tilting movement, this tilting movement, which is desired because it increases the shaving effect, is opposed only slightly by the shear foil. In addition, because it is desirable that dry-shaving apparatus of the type to which the invention relates, being consumer goods, should have an attractive appearance, the lateral surfaces of the apparatus which are adjacent to the ends of the shear foil are required to be joined as smoothly as possible to the curved form of the shear foil. The less the shear foil is deformed during use the better this requirement may be satisfied.

Another embodiment which has proved highly satisfactory is characterized in that each cutting edge has the form of part of an ellipse. The tilting axis of the cutting structure intersects the minor axis of the ellipse on that side of the major axis of the ellipse which is more remote from the cutting edge. Cutter structures having blades the cutting edges of which have a non-circular and in particular an elliptic outline are described in German Patent Application No. 1,553,713 laid open to public inspection. However, the cutter structure described is not tiltable.

BRIEF DESCRIPTION OF THE DRAWINGS

Embodiments of the invention will now be described, by way of example, with reference to the accompanying diagrammatic drawings, in which.

In the Figures corresponding parts are denoted by like reference numerals.

DESCRIPTION OF THE PREFERRED EMBODIMENT

Figure 1:
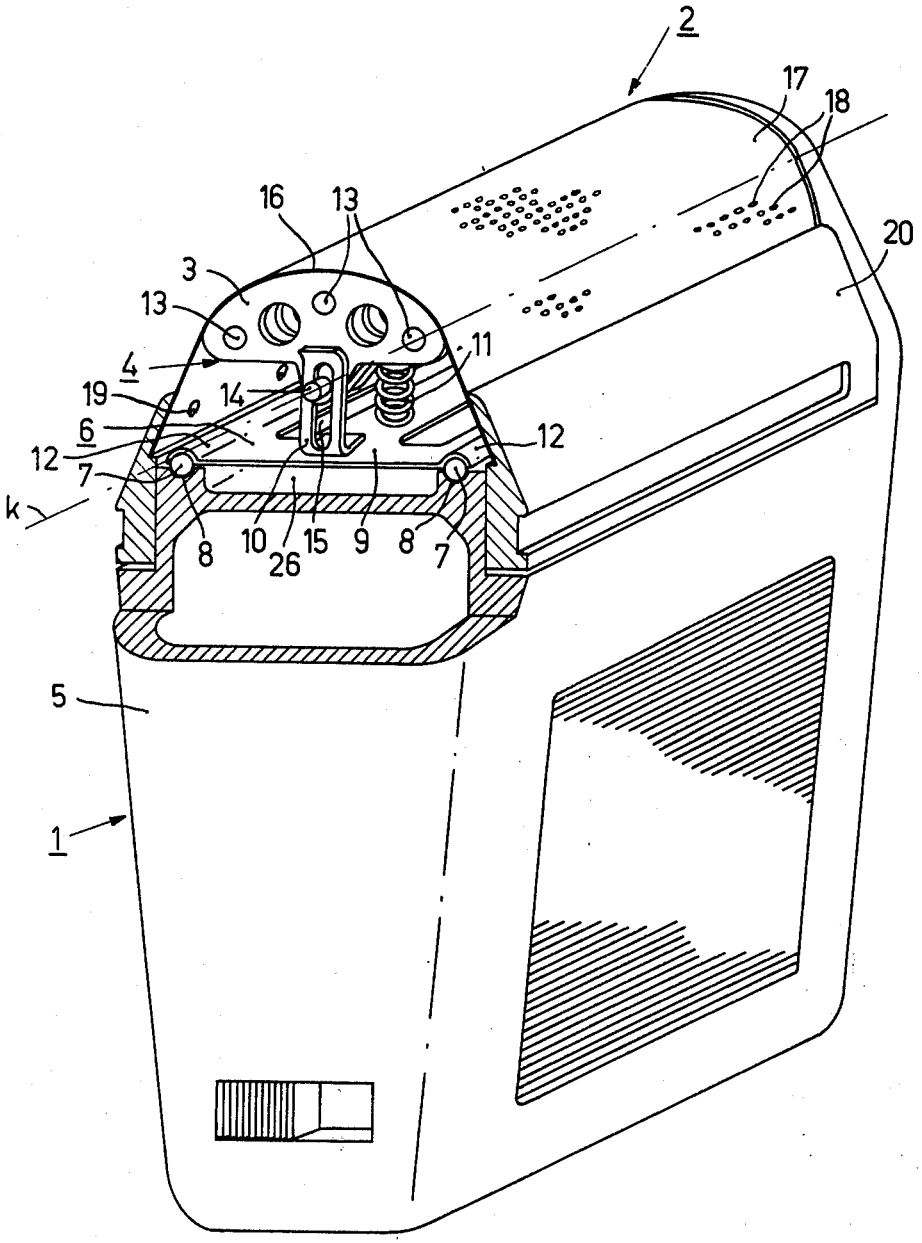
FIG. 1 is a perspective view of a dry-shaving apparatus having a shaving head according to the invention which is shown partly in section.
Figure 2:
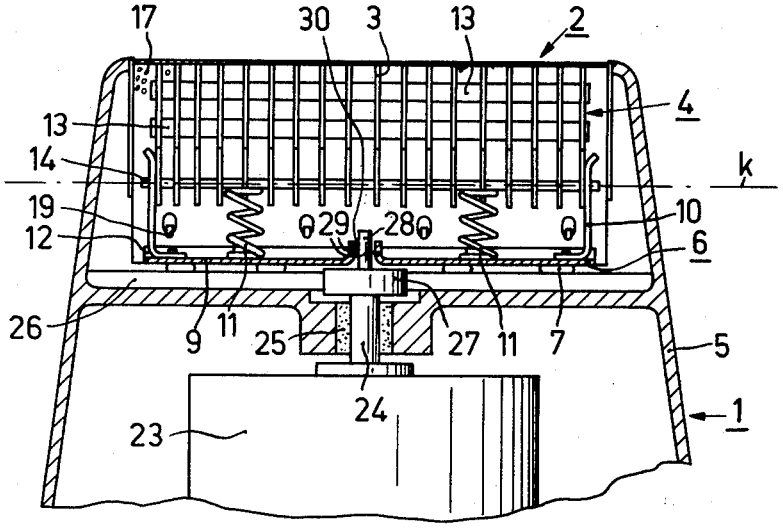
FIG. 2 is a longitudinal sectional view of the other part of the dry-shaving apparatus of FIG. 1.

In FIGS. 1 and 2 the dry-shaving apparatus is designated by 1. The associated shaving head is designated by 2. The dry-shaving apparatus is of the type in which a cutting structure or cutter 4 provided with a plurality of blades 3 is adapted to be driven by an electric driving motor 23 accommodated in a housing 5 of the dry-shaving apparatus 1. The cutting structure 4, hereinafter referred to as cutter structure, is driven by the electric motor into reciprocating translation via a driving member 6 coupled to the motor. The driving member 6 has the form of a reciprocable plate which is mounted on a plurality of balls and may be driven by an electric vibrator motor by means of the end of the reciprocating armature thereof, however, it may alternatively be driven by a rotating motor 23, as is shown in FIG. 2, a motor shaft 24 and the driving member 6 being suitably coupled by a crank-and-slot mechanism. The balls 7 are accommodated in a plurality of straight channel-shaped recesses 8 in the motor housing 5.

The driving member 6 comprises a frame part or support element 9 made of a sheet material, two coupling members 10 secured to this frame and two helically coiled compression springs 11. The plate-shaped frame part 9 at its longer sides has curved portions 12 which correspond with the channel-shaped recesses 8 in the housing 5, enabling the driving member 6 to perform a substantially frictionless reciprocating translation with respect to the housing 5 parallel to axis x—x by means of the balls 7 interposed between the plate-shaped frame part 9 and the housing 5.

The individual blades 3 of the cutter structure 4 are firmly interconnected by three connecting bars 13. The blades 3 at their lower ends are also interconnected by a hinge pin 14 which extends parallel to the direction of movement of the driving member 6. The pin at its ends is accommodated in slots 15 formed in the coupling member 10. These slots 15 extend at right angles to the plate-shaped frame part 9. This construction enables the cutter structure 4 to tilt about a tilting axis *k*, which is the axis of the hinge pin or axle 14, which pin is also capable of sliding in the slots 15 when external pressure is exerted on the cutter structure 4 against the force of the two springs 11.

Cutting edges 16 of the blades 3 cooperate with a thin resilient curved shear foil 17 which is tautly stretched across the cutter structure 4 and in known manner is provided with a plurality of hair entry openings 18. By means of pins 19 the shear foil 17 is secured to a mounting 20 so as to form a removable hood part. The mounting 20 is detachably joined to the housing 5 of the dry-shaving apparatus; the manner of joining is not shown in the drawings but may take a variety of known forms.

FIG. 2 clearly shows that the two springs 11 immediately press against the lower surface of the hinge pin 14. This ensures that when the cutter structure 4 is tilted about the tilting axis *k*, the springs impede the tilting movement in a slight degree only. Obviously, springs of different type may be used and the manner in which the cutter structure 4 is spring-loaded may also be completely different from that described, without the invention being modified thereby.

The motor shaft 24 extends through a bushing 25 into a hair chamber 26 of the dry-shaving apparatus and at its upper end carries a disc 27 in which an eccentric pin 28 is eccentrically secured. The pin cooperates with bent lugs 29 which form the walls of a slot 30 formed in the frame part 9. The eccentric pin 28 together with the slot 30 forms a crak-and-slot mechanism for reciprocatingly driving the frame part 9 and hence the cutter structure 4.

Figure 3:
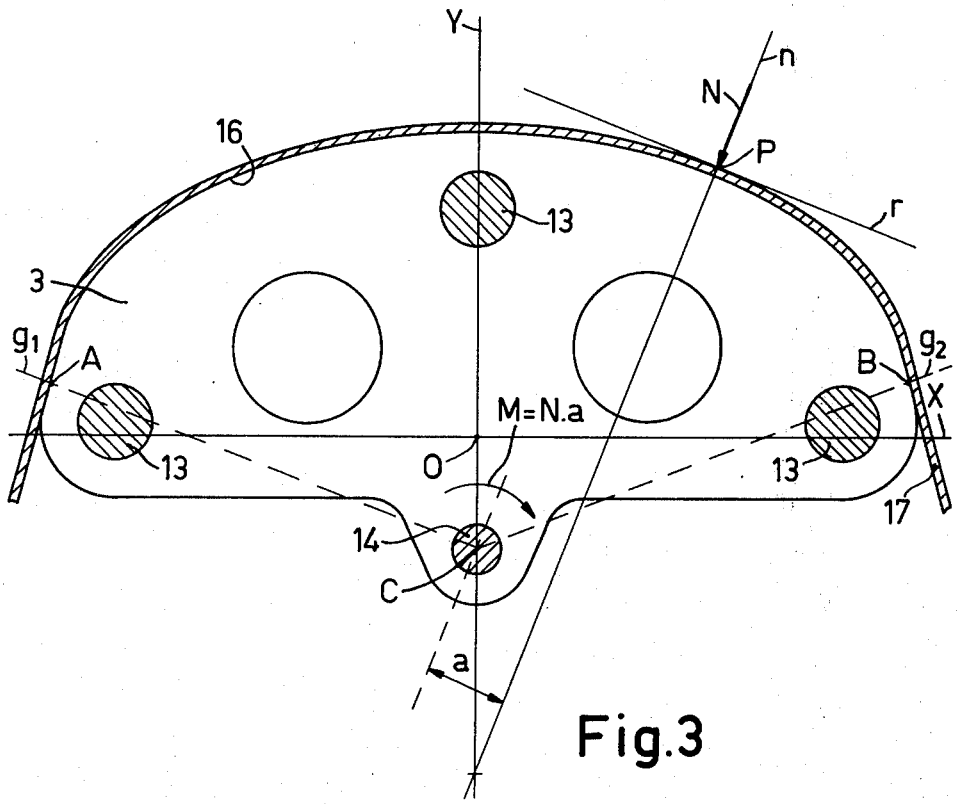
FIG. 3 is a sectional view, on an enlarged scale, of a single semi-elliptic blade of the cutter structure shown in FIG. 1 and of the cooperating part of the shear foil, the Figure further showing points, lines and vectors illustrating the theoretical background of the invention, FIGS. 4, 5 and 6 each show a single blade of differently constructed cutter structures, each blade being tilted through angles of 10° and 20° to illustrate the effect of the tilting on the deformation of the shear foil.

According to the invention the cutting edges 16 of the blades 3 are shaped so that at each point of the shear foil 17 stretched tautly across the blades 3, the local normal always passes the tilting axis *k* on the side more remote from the cutting edges 16 of the blades. This is shown clearly in FIG. 3 which shows, on a greatly enlarged scale, an elevation view of a single blade 3 and a section of part of the shear foil 17 tautly stretched across the blade. The shear foil contacts the cutting edge 16 of the blade 3 from a point A to a point B. The Figure shows two rectangular coordinate axes, the horizontal axis being X axis and the vertical axis being Y axis. The two co-ordinate axes intersect in the origin which is designated by O. The cutting edge 16 of the blade 3 shown has the shape of part of an ellipse. The major axis of the ellipse coincides with the X axis and its minor axis with the Y axis. As a result the cutting edge 16 has a form such that, going from the point A to the point B, the radius of curvature of the cutting edge 16 initially increases gradually and then, after passing the Y axis, gradually decreases. Between the points A and B the shear foil is tautly stretched across the blade 3. A point C is a projection on the plane of the drawing of the axis of the hinge pin 14, and this axis is the tilting axis of the cutter structure. The two points A and B are joined to the point C by broken lines $g_1$ and $g_2$ respectively. An arbitrary point P is shown on the shear foil 17 between the points A and B. A tangent *r* to the surface of the shear foil and a normal *n* at a right angle to the tangent *r* are drawn through the point P. This local normal *n* passes new but spaced from the point C and hence passes near but spaced from the tilting axis of the cutter structure on the side thereof more remote from the cutting edge 16, at a distance *a*. An arrow N represents a normal force acting at the point P of the shear foil in the direction of the normal *n*. This force causes a tilting moment about the point C, which moment is designated by M and has the value Nxa. Because the normal N passes along the point C on the side remote from the cutting edge 16, the tilting moment M will act on the cutter structure in the clockwise direction, with a consequent clockwise rotation of the cutter structure. In other words: the cutter structure will rotate towards the load imposed on it. The lines $g_1$ and $g_2$ through the points A and B respectively represent the local normals at these points A and B respectively. These two normals pass through the point C, so that a normal force acting at a point A or B does not cause the cutter structure to tilt. The lines $g_1$ and $g_2$ are to be regarded as the boundary lines between which tilting towards the load is produced by local normal forces, in other words the lines which bound the range of stable equilibria. Hence it must be ensured that the shear foil 17 does not contact the cutting edge 16 at areas outside the boundary lines because, if normal forces should act on the cutter structure outside the said stable range, an unstable equilibrium would result and hence the cutter structure would rotate away from the load. Obviously this problem does not arise when the construction of the shaving head is such that the skin cannot come into contact with the shear foil outside the boundary lines.

The point C and hence the tilting axis of the cutter structure are situated on the side of the X axis, and hence of the major axis of the ellipse of which the cutting edge 16 forms part, more remote from this cutting edge 16. The importance of this configuration will be explained with reference to FIGS. 4, 5 and 6.

Figure 4:
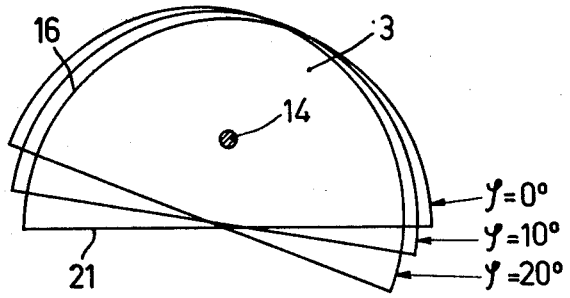

The blade 3 shown in FIG. 4 has a semi-circular cutting edge 16, the centre of the circle lying on a lower edge 21 of the blade. The blade is shown in three different positions, namely an initial position with an associated tilting angle $\phi = 0°$ and two positions in which the blade has been tilted about the hinge pin 14 through tilting angles of $\phi = 10°$ and $\phi = 20°$ respectively.

Figure 5:
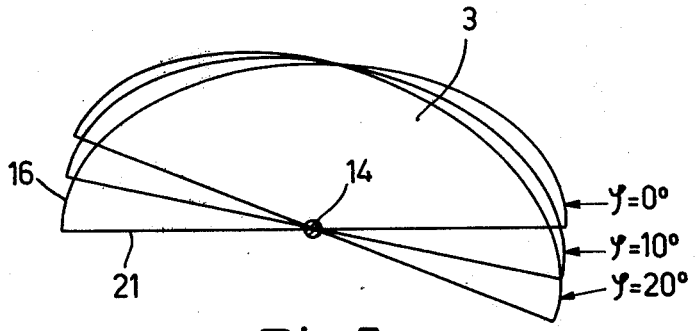
Figure 6:
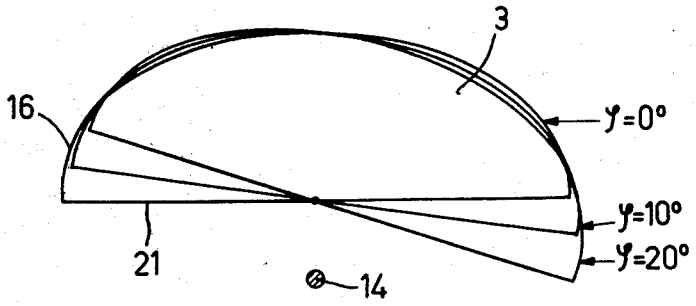

FIGS. 5 and 6 show similar situations, however, in FIG. 5 the blade 3 has a semi-elliptical cutting edge 16 and the hinge pin 14 passes through the centre of the ellipse which lies on the lower edge 21, while in FIG. 6 the blade has the same semi-elliptical shape but the hinge pin is arranged below the centre.

FIG. 6 shows that the cutting edge of the blade in a tilted position thereof follows substantially the same curve as in the initial position. This means that when a cutter structure comprising blades 3 which in the shape and in the position of the hinge pin 14 correspond to the blade shown in FIG. 6 is used, the shear foil will be deformed only slightly when the cutter structure is tilted.

The embodiments shown in FIGS. 4 and 5 are less satisfactory in these respects. In the case of slight deformation of the foil a cutting structure having a configuration shown in FIG. 6 will more readily be able to perform its tilting movement, because the forces and moments which are produced by the deformation and counteract the tilting movement will be smaller.

Figure 7:
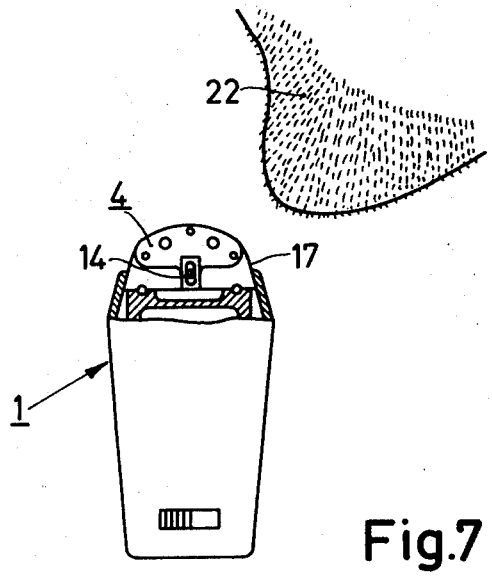
FIGS. 7 and 8 show the effect of the invention produced in the use of a shaving head.
Figure 8:
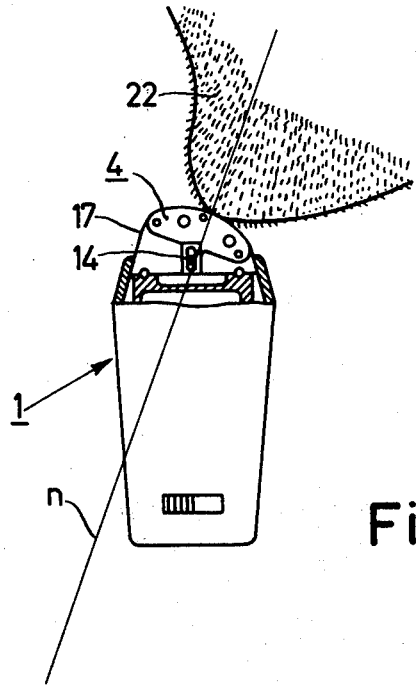

The effect of the invention is illustrated in FIGS. 7 and 8, in which the dry-shaving apparatus 1 of FIGS. 1 and 2 is shown on a reduced scale with the omission of a number of details, the Figure further showing part of the face, viz. the chin 22, of a person using the apparatus. As long as the shear foil 17 is not pressed against the face (FIG. 7) the cutter structure 4 will reciprocate in the neutral position shown. This is a stable state, because any tilting of the cutter structure about the hinge pin 14 away from the neutral position automatically produces forces which counteract the tilting.

FIG. 8 shows how the cutter structure tilts in the case of such contact with the chin 22 of the user that at the area of contact the local normal n does not correspond with the direction of the neutral position of the cutter structure 4.

The tilting shown in FIG. 8 substantially does not occur when the dry-shaving apparatus is not switched on, because in this event the frictional forces which counteract the tilting are too large. When the apparatus is switched on, however, the rapid reciprocating movements of the cutter structure will cause the said frictional forces to be reduced so that the stable tilted position is reached after only a few reciprocating movements.

What is claimed is:

1. In a dry-shaver including a housing having a top part, and an electric motor with a drive member, the improvement in combination therewith of a shaving head comprising a cutter having a first longitudinal axis, support means carrying the cutter and mounted on the top part of said housing and reciprocally movable thereon in the longitudinal direction parallel to said first axis, said cutter being mounted on said support means about a pivot axis generally parallel to said first axis, and guide means defining a straight line and cooperating with said support means for guiding reciprocal lateral movement of the cutter toward and away from said top part when said pivot axis moves along said straight line of the guide means, said cutter comprising blades with cutting edges which are generally normal to said first axis and are aligned and define a convex curved surface extending outward from said top part, said drive member driving said cutter in said longitudinal direction, said shaving head further comprising a perforated foil shear plate wrapped about said edges and secured to said housing, and spring means being carried by said support means for urging said cutter outward with said edges against said foil, said edges each having a curved shape including a center part, said support means further comprising a support element situated inbetween said cutter and the top part of said housing, said support element being reciprocally movable by said drive member generally parallel to said first axis, said guide means also carried by said support element and including a slot extending outward from said housing, said support means further comprising axle means extending from said cutter along the pivot axis thereof and engaging said slot means for permitting said pivoting and lateral movement of the cutter.

2. Apparatus according to claim 1 wherein said spring means comprises a pair of springs spaced apart lengthwise of said cutter.

3. Apparatus according to claim 1 wherein said cutting edges define elliptical curves.

* * * * *